US010267002B2

(12) United States Patent
Couch et al.

(10) Patent No.: US 10,267,002 B2
(45) Date of Patent: Apr. 23, 2019

(54) CURRENT SHIELD

(71) Applicant: Oceaneering International, Inc., Houston, TX (US)

(72) Inventors: Jack Couch, Patterson, LA (US); Matthew James Caston, Houston, TX (US); Kyle William Gebhardt, Houston, TX (US); Scott Edward Hermann, Cypress, TX (US)

(73) Assignee: Oceaneering International, Inc., Houston, TX (US)

( * ) Notice: Subject to any disclaimer, the term of this patent is extended or adjusted under 35 U.S.C. 154(b) by 100 days.

(21) Appl. No.: 15/344,951

(22) Filed: Nov. 7, 2016

(65) Prior Publication Data

US 2017/0130413 A1 May 11, 2017

Related U.S. Application Data

(60) Provisional application No. 62/252,454, filed on Nov. 7, 2015.

(51) Int. Cl.
*E02B 3/00* (2006.01)
*B63C 11/52* (2006.01)

(52) U.S. Cl.
CPC ..... *E02B 3/00* (2013.01); *B63C 11/52* (2013.01)

(58) Field of Classification Search
CPC ..... E02B 3/00; B63C 11/52; F03B 17/062
See application file for complete search history.

(56) References Cited

U.S. PATENT DOCUMENTS 402,055 A * 4/1889 Besemer ..... F03B 17/066 415/5
1,449,426 A * 3/1923 Loveless ..... F03B 17/06 415/5
4,494,008 A * 1/1985 Patton ..... F01D 23/00 290/44
2005/0099012 A1* 5/2005 Williams, Jr. ..... F03B 17/062 290/54
2008/0304915 A1* 12/2008 Bang ..... B23D 57/0084 405/224.1
2013/0272796 A1* 10/2013 Horton, III ..... E02B 17/02 405/204
2014/0138954 A1* 5/2014 Antonucci ..... F03B 17/061 290/54

* cited by examiner

*Primary Examiner* — Tara Mayo-Pinnock
(74) *Attorney, Agent, or Firm* — Maze IP Law, P.C.

(57) ABSTRACT

In its various embodiments the claimed water current shield may be used to improve safety for a diver and/or a remotely operated vehicle (ROV) by lowering the water current shield with a crane with the louvers initially in a first position to allow water current to flow through the louvers, positioning the water current shield with hold-back rigging from an up-current side of the subsea work site, adjusting an open or closed characteristic of the louvers if drag from the water current needs to be reduced around the subsea work site, and closing the louvers to protect an object proximate the water current shield from the water current, thereby shielding divers and/or ROVs from water currents at an underwater work site. The water current shield generally comprises a frame; a predetermined set of louver assemblies operatively connected to the frame, where each louver assembly comprises one or more selectably movable louvers; and a louver mover operatively connected to each selectably movable louver.

16 Claims, 4 Drawing Sheets

CURRENT SHIELD

RELATIONSHIP TO PRIOR APPLICATIONS

This application claims benefit through U.S. patent Provisional application 62/252,454 filed on Nov. 7, 2015 and titled "Current Shield."

BACKGROUND OF THE INVENTION

Offshore construction projects often see significant delays due to strong currents that may slow the ability of the divers and remotely operated vehicles (ROV) to work effectively as significant effort is spent just holding on at the work site. Currents have slowed or halted diving operations from the beginning.

FIGURES

Various figures are included herein which illustrate aspects of embodiments of the disclosed inventions.

DESCRIPTION OF EXEMPLARY EMBODIMENTS

Figure 5:
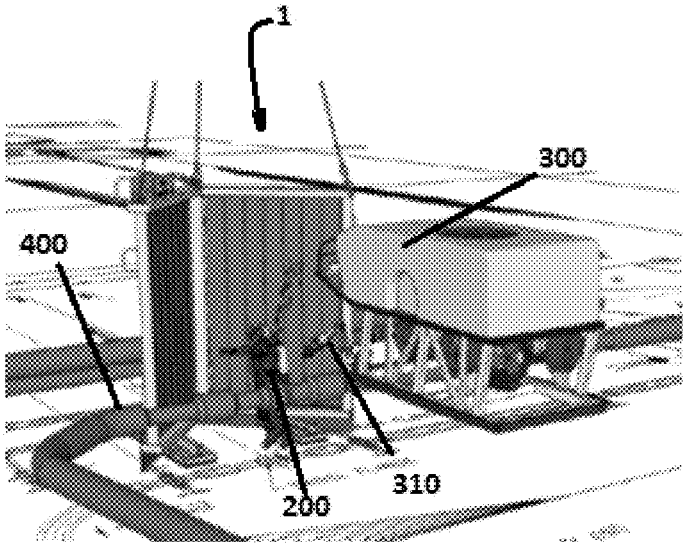
FIG. 5 is a view in partial perspective of an exemplary embodiment of a water current shield system.
Figure 6:
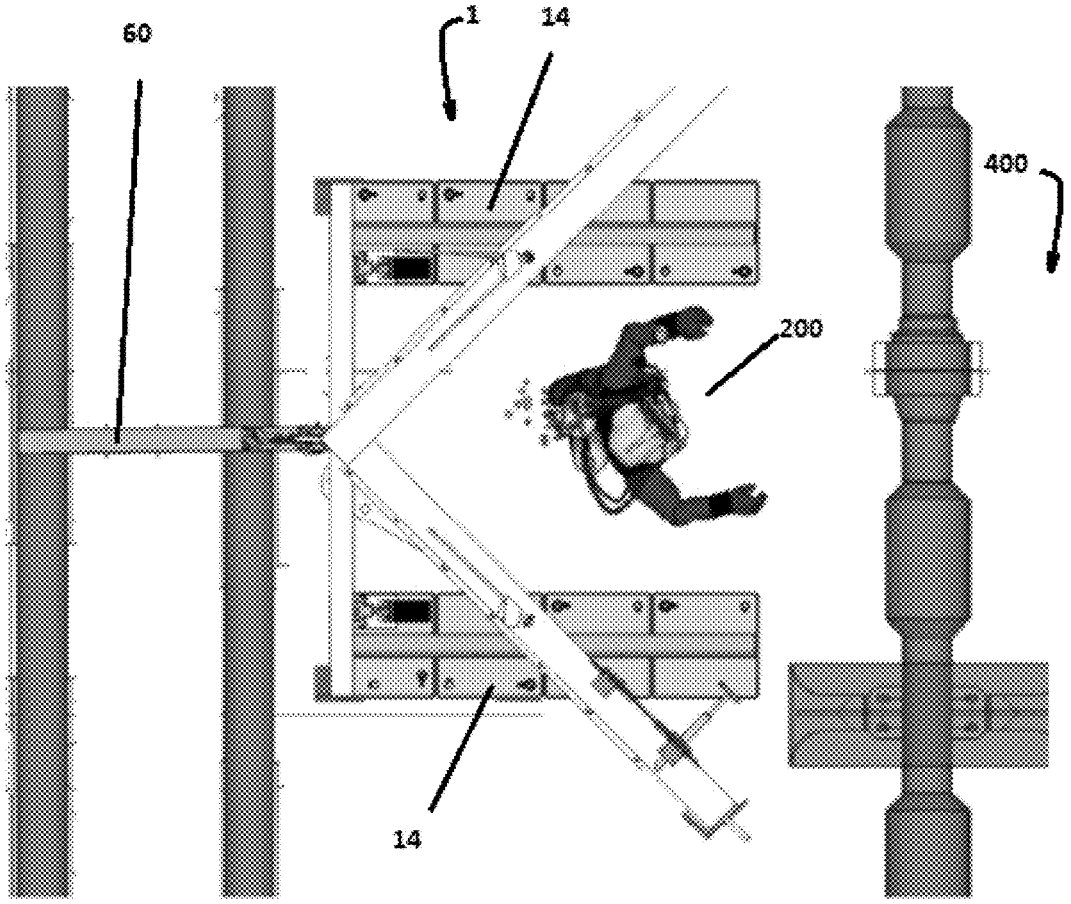
FIG. 6 is a view in partial top down perspective of an exemplary embodiment of a water current shield system.

Referring generally to FIGS. 5 and 6, in its various embodiments water current shield 1 may be used to improve safety for diver 200 and/or remotely operated vehicle (ROV) 300 by shielding them from water currents, thereby allowing them to avoid excess fatigue from the water currents at the underwater work sites. It may also extend an environmental range that the projects can proceed in without facing the need to go on weather standby or off hire. As described below, in its embodiments, water current shield 1 provides a shield from ocean or other water currents that either diver 200 and/or ROV 300 could get behind and work while being protected from the water current while working in a localized location such as hull piping flange connections.

Figure 1:
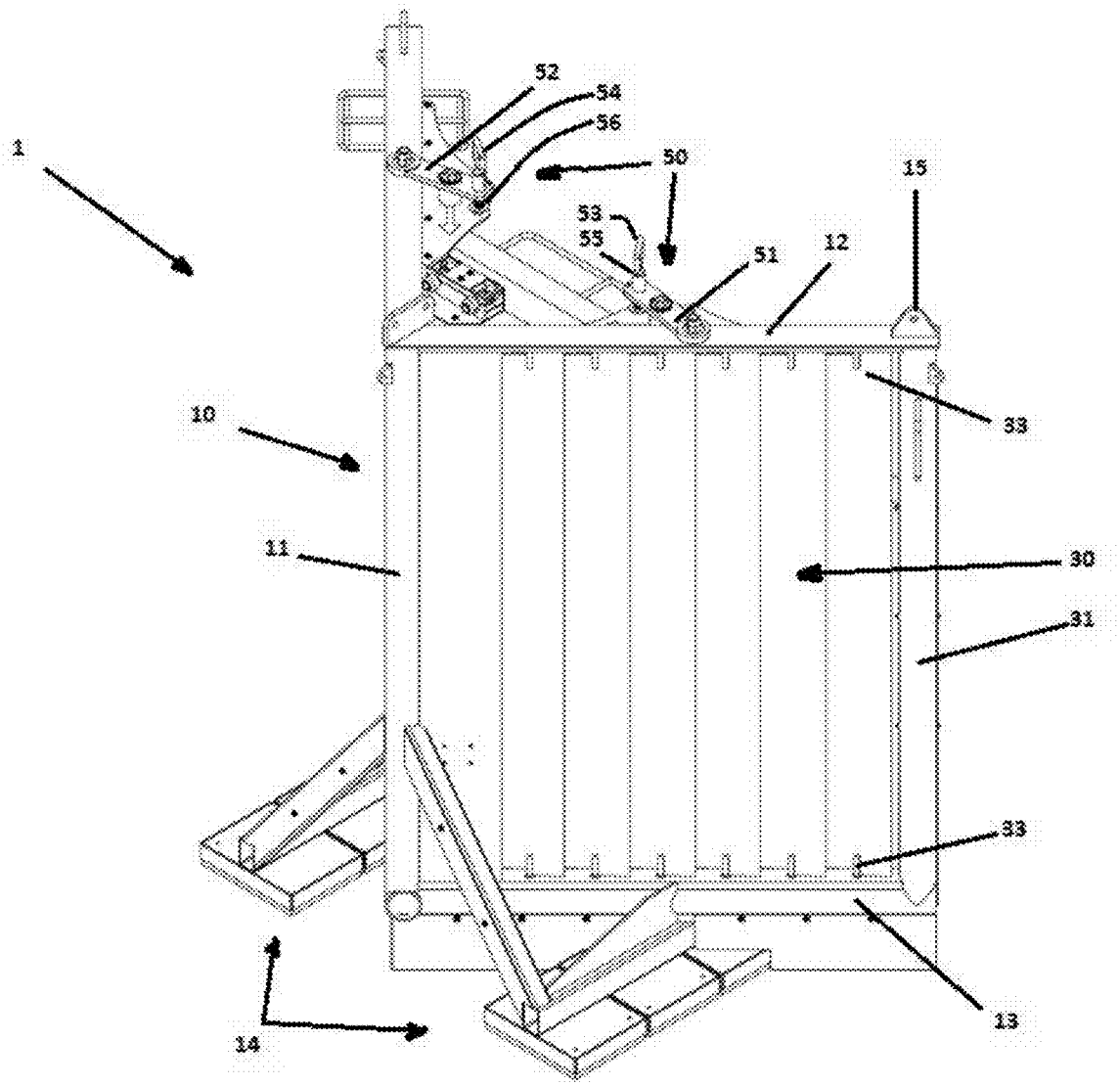
FIG. 1 is a side view in partial top down perspective of an exemplary embodiment of a water current shield.
Figure 2:
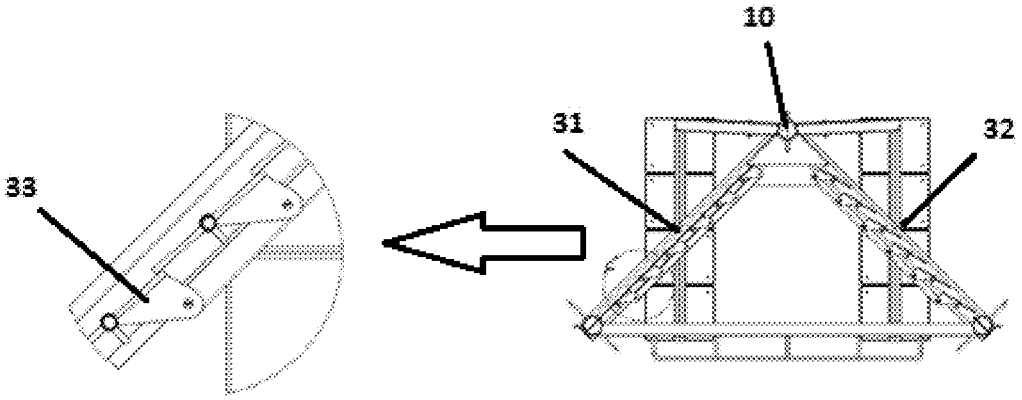
FIG. 2 is a top down view in partial perspective with a detail of an hinge assembly of an exemplary embodiment of a water current shield.

Referring now generally to FIG. 1, water current shield 1 comprises frame 10; a predetermined set of louver assemblies 30 operatively connected to frame 10, each louver assembly comprising one or more selectably movable louvers 31,32 (FIG. 2); and louver mover 50 operatively connected to each selectably movable louver.

Frame 10 comprises post 11; a set of upper louver attachment arms 12 connected to post 11 at a predetermined offset angle; a complimentary set of lower louver attachment arms 13 connected to post 11 at the same predetermined offset angle; and stationer 14 connected to the post. Upper louver attachment arms 12 and lower louver attachment arms 13 may be fixed at the predetermined offset angle or adjustable to dynamically set upper louver attachment arms 12 and lower louver attachment arms 13 at the predetermined offset angle.

As used herein, stationer 14 comprises structures configured to provide stability to water current shield 1 once deployed in water such as on a subsea sea bed. Stationer 14 may comprise a predetermined set of feet, suction pads, eductors, or the like, or a combination thereof. Typically, if present a first subset of the predetermined set of suction pads or eductors is configured to operate independently of a second subset of the predetermined set of suction pads or eductors such as by use of check valves and/or associated plumbing (not shown in the figures).

Louvers 31,32 may be selectively and independently opened or closed, providing protection from the water current for the diver's work area. Generally, the predetermined set of louver assemblies 30 are hingedly connected to frame 10 such as by hinge assemblies 33 (FIG. 2) and/or pivots 33 associated with the set of upper louver attachment arms 12, hinges 33 associated with the set of lower louver attachment arms 13, or the like, or a combination thereof. Typically, a space is created within or substantially within the predetermined set of louver assemblies 30 which defines a space sufficient to protect a diver and/or a remotely operated vehicle from water currents.

Louver mover 50 is operatively connected to the predetermined set of louver assemblies 30. In embodiments, louver mover 50 comprises one or mover closure bars 51,52 where there are typically one closure bar for each louver assembly. By way of example and not limitation, first closure bar 51 may be attached to louver assembly 31 and second closure bar 52 may be attached to louver assembly 32. These closure bars 51,52 may be configured to operate independently or cooperatively. Typically, closure bars 51,52 are attached to handles 53,54 where handles 53,54 are operated by diver 200 (FIG. 5) and/or ROV 300 (FIG. 6) and may be manipulated and/or secured in a louver open, partially open, and/or closed position by use of pins 55,56.

Figure 4:
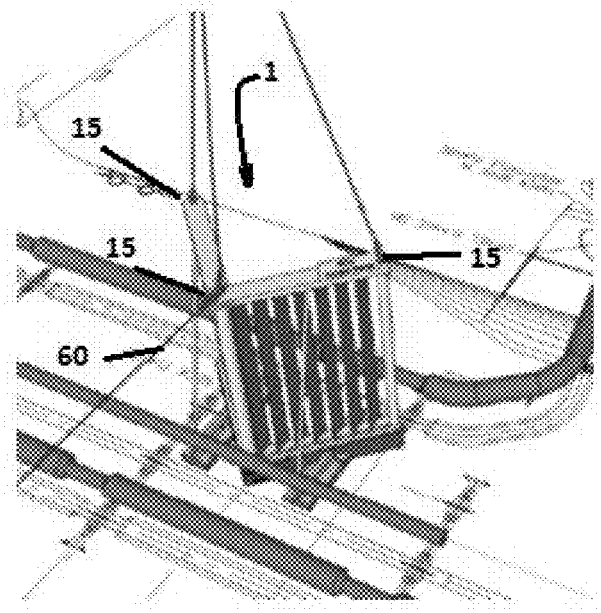
FIG. 4 is a view in partial top down perspective of an exemplary embodiment of a water current shield system.

Referring additionally to FIG. 4, in certain embodiments safety strap 60, adapted to provide redundant protection for diver 200 (FIG. 5) should any of the suction pads or eductors loose vacuum, may be used to secure water current shield 1 in place such as by being attached to a predetermined part of frame 10 such as to offsetting padeyes 15 which may be located at various predetermined portions of frame 10, e.g. on set of upper louver attachment arms 12 and/or post 11.

Figure 3:
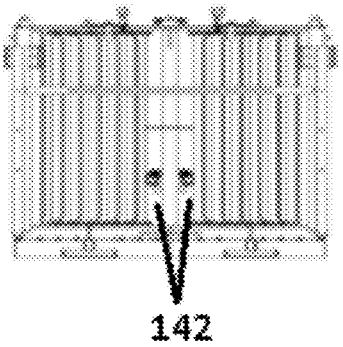
FIG. 3 is a view in partial frontal perspective of an exemplary embodiment of a water current shield system.

Referring now to FIGS. 4-6, system 100 comprises water current shield 1, as described above; crane 110 (not shown in the figures) adapted to attach to and lower water current shield 1 into water such as by cables 121 attached to offsetting padeyes 11; hold-back rigging 120 deployable from a far side of the facility (up current side); and ROV 300. ROV 300 typically comprises hydraulic hot stab 310 adapted to power one or more hydraulic suction pumps 142 (FIG. 3) which will pull a vacuum in stationer 14.

In the operation of an exemplary embodiment, water current shield 1 may be lowered with crane 110 and pulled into position such as with hold-back rigging 120 from the far side of the facility (up current side). The current shield is as described above and comprises louver assemblies 30 that may be opened to reduce the drag from the current, making it possible to position and set water current shield 1 during the installation to allow the water current to flow around and/or through water current shield 1 during installation. This helps to avoid over loading the rigging used to install water current shield 1 and ease the positioning of water current shield 1 where needed.

Stationer 14, as described above, may be used to hold water current shield 1 in place without damaging the underwater work site.

An area directly up current of the underwater work site may be cleaned of any heavy marine growth to the extent allowed by the water currents. Hold-back rigging 120 may be used to pull water current shield 1 into position as directed by ROV 300 and carefully positioned just up current of the proposed underwater work site.

Once lowered into place, such as in contact with underwater pontoon 400, ROV 300 may use hydraulic hot stab 141 to power hydraulic suction pumps 142 (FIG. 3) to pull a vacuum in stationer 14. Stationer 14 may comprise multiple suction pads or eductors to selectively allow for some of the pads or eductors to not be able to pull a vacuum due to marine growth, large dents, hull deformities, and the like, or a combination thereof. Where multiple suction pads and/or eductors are present, predetermined sets of these may be independently operable. By pulling the vacuum in stationer 14 such as with one or more hydraulic pumps 141 driven by ROV 300, use of surface umbilicals which would create serious drag on water current shield 1 due to the vertical loading on a umbilical from the current flow may be avoided. Once stationer 14 is confirmed to be holding a proper suction such as via gage reading, louvers 31 may be fully or partially closed, blocking the water current at the proposed underwater work site.

Making water current shield 1 installable by ROV 300 allows water current shield 1 to be installed in water currents in which ROV 300 can operate but diver 200 could not. The movable louver system further allows water current shielding when needed, but louvers 31,32 can also be opened when leaving the underwater work site so that the loading on water current shield 1 is minimal except during actual use.

The foregoing disclosure and description of the inventions are illustrative and explanatory. Various changes in the size, shape, and materials, as well as in the details of the illustrative construction and/or an illustrative method may be made without departing from the spirit of the invention.

The invention claimed is:

1. A water current shield, comprising:

a) frame, comprising:

i) a post;

ii) a set of upper louver attachment arms, a first member of the set of upper louver attachment arms connected to the post at a first predetermined offset angle and a second member of the set of upper louver attachment arms connected to the post at a second predetermined offset angle;

iii) a set of lower louver attachment arms, a first member of the set of lower louver attachment arms connected to the post at the first predetermined offset angle and a second member of the set of lower louver attachment arms connected to the post at the second predetermined offset angle; and iv) a stationer connected to the post;

b) a predetermined set of louver assemblies operatively connected to the frame intermediate the upper louver attachment arms and the lower louver attachment arms, each louver assembly comprising a selectably movable louver; and c) a louver mover operatively connected to each selectably movable louver and operative to allow the louver assemblies to be placed and secured into an open, partially open, and/or closed position.

2. The water current shield of claim 1, wherein the set of louver assemblies are hingedly connected to the frame.

3. The water current shield of claim 1, wherein the stationer comprises a predetermined set of suction pads and/or eductors, a first subset of the predetermined set of suction pads and/or eductors configured to operate independently of a second subset of the predetermined set of suction pads and/or eductors by use of check valves and assorted plumbing.

4. The water current shield of claim 1, further comprising a safety strap connected to a securing point on the frame, the safety strap adapted to be connected to a structure subsea.

5. The water current shield of claim 1, wherein the predetermined set of louver assemblies are connected to the post in a manner that defines a space sufficient to protect a diver from water currents.

6. The water current shield of claim 1, wherein the predetermined set of louver assemblies are connected to the post in a manner to define a space sufficient to protect a remotely operated vehicle from water currents.

7. The water current shield of claim 1, wherein the louver mover comprises a mover closure bar operatively connected to a louver assembly.

8. The water current shield of claim 7, wherein:

a) the mover closure bar comprises a first closure bar operatively connected to a first louver assembly; and b) a second closure bar operatively connected to a second louver assembly.

9. The water current shield of claim 7, further comprising a handle operatively connected to the mover closure bar.

10. The water current shield of claim 7, further comprising a pin configured to secure the louver assembly into an open, partially open, and/or closed position.

11. A system, comprising:

a) a water current shield, comprising:

i) a frame, comprising:

1) a post;

2) a set of upper louver attachment arms, a first member of the set of upper louver attachment arms connected to the post at a first predetermined offset angle and a second member of the set of upper louver attachment arms connected to the post at a second predetermined offset angle;

3) a set of lower louver attachment arms, a first member of the set of lower louver attachment arms connected to the post at the first predetermined offset angle and a second member of the set of lower louver attachment arms connected to the post at the second predetermined offset angle; and 4) a stationer connected to the post;

ii) a predetermined set of louver assemblies operatively connected to the frame intermediate the upper louver attachment arms and the lower louver attachment arms, each louver assembly comprising a selectably movable and securable louver; and iii) a louver mover operatively connected to each selectably movable louver and operative to allow the louver assemblies to be placed into an open, partially open, and/or closed position;

b) a crane adapted to attached and lower the water current shield into water;

c) hold-back rigging attached to the water current shield from an up-current side; and d) a remotely operated vehicle comprising a hydraulic hot stab adapted to power hydraulic suction pumps which will pull a vacuum in the stationer.

12. A method of providing an object with protection from a water current at a subsea work site using a water current shield comprising a frame, the frame comprising a post, a set of upper louver attachment arms where a first member of the set of upper louver attachment arms is connected to the post at a first predetermined offset angle and a second member of the set of upper louver attachment arms is connected to the post at a second predetermined offset angle, a set of lower louver attachment arms where a first member of the set of lower louver attachment arms is connected to the post at the first predetermined offset angle and a second member of the set of lower louver attachment arms is connected to the post at the second predetermined offset angle and a stationer connected to the post, a predetermined set of louver assemblies operatively connected to the frame intermediate the upper louver attachment arms and the lower louver attachment arms where each louver assembly comprises a selectably movable louver and a louver mover operatively connected to each selectably movable louver and operative to allow the louver assemblies to be placed into an open, partially open, and/or closed position, the method comprising:

a) lowering the water current shield with a crane, the louvers initially in a first position to allow water current to flow through the louvers;

b) positioning the water current shield with hold-back rigging from an up-current side of the subsea work site;

c) adjusting an open or closed characteristic of the louvers if drag from the water current needs to be reduced around the subsea work site; and d) closing the louvers to protect an object proximate the water current shield from the water current.

13. The method of claim 12, further comprising using a hydraulic hot stab from a remotely operated vehicle to power hydraulic suction pumps and pull a vacuum in the stationer.

14. The method of claim 12, further comprising:

a) using a gauge to confirm proper suction being maintained on the stationer; and b) once confirmed, closing the louvers and blocking the water current at the subsea work site.

15. The method of claim 12, further comprising using the hold-back rigging to pull the water current shield into position as directed by a remotely operated vehicle positioned just up current of the subsea work site.

16. The method of claim 12, wherein the object comprises a human diver or a remotely operated vehicle ("ROV").

* * * * *